US006605185B2

(12) United States Patent
Sasaki et al.

(10) Patent No.: US 6,605,185 B2
(45) Date of Patent: Aug. 12, 2003

(54) METHOD OF MANIPULATING DRYER STEAM PRESSURE IN PAPER MACHINE DURING GRADE CHANGE AND APPARATUS FOR THE METHOD

(75) Inventors: Takashi Sasaki, Tokyo (JP); Takao Maruyama, Tokyo (JP); Kenichiro Yahiro, Tokyo (JP)

(73) Assignee: Yokogawa Electric Corporation, Musashino (JP)

( * ) Notice: Subject to any disclaimer, the term of this patent is extended or adjusted under 35 U.S.C. 154(b) by 0 days.

(21) Appl. No.: 09/899,795

(22) Filed: Jul. 5, 2001

(65) Prior Publication Data

US 2002/0104636 A1 Aug. 8, 2002

(30) Foreign Application Priority Data

Jul. 24, 2000 (JP) ..... 2000/222052

(51) Int. Cl.[7] ..... D21F 5/06

(52) U.S. Cl. ..... 162/198; 162/263; 34/446; 34/568; 700/128

(58) Field of Search ..... 162/204, 206, 162/207, 197, 198, 252, 253, 262, 263, 270, 271, DIG. 6, DIG. 10; 156/64; 34/445, 446, 447, 523–528, 558, 565, 568; 700/30, 31, 127, 128, 129, 208

(56) References Cited

U.S. PATENT DOCUMENTS 3,676,295 A * 7/1972 Rice ..... 162/198
3,801,426 A * 4/1974 Putman et al. ..... 162/198
5,718,060 A * 2/1998 Mori ..... 34/117

* cited by examiner

*Primary Examiner*—Steven P. Griffin
*Assistant Examiner*—Eric Hug

(57) ABSTRACT

A method and apparatus for manipulating dryer steam pressure in a paper machine during grade change, wherein change in moisture percentage is determined from a change in production amount during grade change, dryer stream pressure is manipulated so as to cancel the change in the moisture percentage, and production amount during grade change is calculated from basis weight and machine speed before and after grade change, whereby moisture percentage is kept constant during grade chagne so that sheet breaks are avoided and downtime is reduced.

4 Claims, 6 Drawing Sheets

CALCULATION PART OF STEAM PRESSURE MANIPULATION CHANGE VALUE

| | BEFORE GRADE CHANGE | AFTER GRADE CHANGE |
|---|---|---|
| BASIS WEIGHT(g/m²) | 101.6 | 127.1 |
| MACHINE SPEED (m/min) | 680 | 550 |
| PRE-DRYER STEAM PRESSURE (kPa) | 211 | 217 |

| | BEFORE GRADE CHANGE | AFTER GRADE CHANGE |
|---|---|---|
| BASIS WEIGHT(g/m²) | 131.05 | 153.05 |
| MACHINE SPEED (m/min) | 580 | 500 |
| PRE-DRYER STEAM PRESSURE (kPa) | 212 | 217 |

| | BEFORE GRADE CHANGE | AFTER GRADE CHANGE |
|---|---|---|
| BASIS WEIGHT(g/m²) | 114.79 | 78.13 |
| MACHINE SPEED (m/min) | 630 | 750 |
| PRE-DRYER STEAM PRESSURE (kPa) | 262 | 142 |

| | BEFORE GRADE CHANGE | AFTER GRADE CHANGE |
|---|---|---|
| BASIS WEIGHT(g/m²) | 104.4 | 76.38 |
| MACHINE SPEED (m/min) | 720 | 780 |
| PRE-DRYER STEAM PRESSURE (kPa) | 254 | 135 |

METHOD OF MANIPULATING DRYER STEAM PRESSURE IN PAPER MACHINE DURING GRADE CHANGE AND APPARATUS FOR THE METHOD

BACKGROUND OF THE INVENTION

1. Field of the Invention

The present invention relates to improvements in the method of transiently manipulating dryer steam pressure in a paper machine during grade change.

Traditionally, steam pressure has been manipulated on the assumption that a change in the production amount of paper due to a change in dryer load varies linearly during grade change and such that the moisture percentage is changed by an appropriate amount to compensate the production amount change. For this reason, no compensation has been made for the non-linear part of the production amount change. Consequently, the moisture percentage momentarily rises above the target value in the course of grade change, causing problems in plant operation. Problems resulting from an increase in the moisture percentage include the following:

If the moisture percentage increases in the course of grade change, the paper in production may become crinkled or broken.

If the moisture percentage increases at the end of grade change, it will take a long time for the moisture percentage to return to the target value. Another problem is that the increase causes the moisture profile to deteriorate. Consequently, it will take a long time to completely change to the next type of product after grade change and therefore plant uptime is reduced.

To solve these problems, it is required to bring the moisture percentage as close as possible to the target value even during grade change. A general object of the present invention is to provide a method of manipulating steam pressure wherein a change in the production amount during grade change is precisely estimated and dryer steam pressure is manipulated so as to compensate the change in the production amount, so that the moisture percentage agrees with the target value during the grade change.

2. Description of the Prior Art

FIG. 1 is a diagrammatic view showing the configuration of a paper machine. Raw material discharged out of a headbox HB is dehydrated as the material passes through a wire part WP. Then, the material is dried out by a dryer DR and rolled round a reel RL. White water produced as the result of dehydration at the wire part WP is then received by a pit PT and fed back to the headbox HB by a fan pump PMP. Basis weight and moisture percentage are measured by a measuring instrument BM and input to a controller CMT. The controller CMT controls a stock control valve VLV according to the differences of the measured basis weight and moisture percentage from their target values, in order to adjust the inflow rate of raw material. The controller CMT also manipulates a steam pressure controller PRC to control steam pressure for drying. The component indicated by a symbol SB is a stock box where the raw material is contained.

When a grade change needs to be made, the controller CMT manipulates the stock control valve VLV to adjust the flow rate of raw material to be injected into the headbox HB and the machine speed. Furthermore, the controller CMT changes the manipulated variable of steam pressure to be output to the steam pressure controller PRC. In this case, a dead time occurs since there is a certain distance between the stock control valve VLV and the headbox HB. In addition, the system composed of the dryer DR has a large delay time constant. Control therefore must be carried out in consideration of the dead time and delay time constant when grade change is made. In the specifications of Japanese Patent Publication Nos. 11718 and 27437 of 1984, the applicant disclosed a method of steam pressure manipulation during grade change. The invention described in these publications will now be explained.

FIG. 2 is a diagrammatic view showing the configuration of a process model where the dead time and a first-order delay system are feed-forward controlled in an open loop. In this figure, the output of a feed-forward controller CON is applied to a process PRS through a hold circuit HLD. Consequently, a manipulation-caused moisture percentage change B(s) is obtained. Synthesizing the B(s) and a disturbance D(s) gives an actual moisture percentage change C(s).

Note here that the transfer functions H(s) and P(s) of the hold circuit HLD and process PRS are represented by the following formulas, respectively.

$$H(s) = \frac{1 - e^{-Ts}}{s}$$

$$P(s) = \frac{Ke^{-Ls}}{1 + T_0 s}$$

where

T=Sampling interval $T_o$=Time constant

L=Dead time (L=m*T, where m is 0 or a natural number)

K=Process gain.

Z-transforming the composition of these two transfer functions gives the following result:

$$\begin{aligned} HP(Z) = Z[H(s) * P(s)] &= Z\left[\frac{1 - e^{-Ts}}{s} * \frac{Ke^{-Ls}}{1 + T_0 s}\right] \\ &= K(1 - z^{-1})z^{-m} * Z\left[\frac{1}{s(1 + T_0 s)}\right] \\ &= K(1 - z^{-1})z^{-m} * Z\left[\frac{1}{s} - \frac{1}{s + T_0^{-1}}\right] \\ &= K(1 - z^{-1})z^{-m}\left(\frac{1}{1 - z^{-1}} - \frac{1}{1 - e^{-T/T_0}z^{-1}}\right) \\ &= \frac{K(1 - \alpha)z^{-(m+1)}}{1 - \alpha z^{-1}} \end{aligned}$$

where $\alpha = e^{-T/T_0}$.

The necessary and sufficient conditions for G(z) in FIG. 2 to be able to settle finitely in the settling time of (N+m)·T (m is a natural number) are that equations 1.1 and 1.2 hold true for a given set of values $a_1, a_2, \ldots, a_N$, and $A_0$, according to the final-value theorem, as shown below.

$$G(z) = A_0(1 - \alpha z^{-1})\{1 + a_1 z^{-1} + a_2 z^{-2} + \ldots + a_{N-1} z^{-(N-1)} \quad (1.1)$$

$$\lim_{z \to 1} A_0 K(1 - \alpha)z^{-(m+1)}\{1 + a_1 z^{-1} + a_2 z^{-2} + \ldots + a_{N-1} z^{-(N-1)}\} = 1 \quad (1.2)$$

From equation 1.2, we have $$A_0 = \frac{1}{K(1 - \alpha)(1 + a_1 + a_2 + \ldots + a_{N-1})}$$

By substituting this equation into equation 1.1, we obtain $$G(z) = \frac{1 - \alpha z^{-1}}{KA(1-\alpha)}\left\{1 + \sum_{i=1}^{N-1} a_i z^{-i}\right\}$$

where $A=1+a_1+a_2+\ldots+a_{N-1}$.

By rearranging this equation for G(Z), we have $$\begin{aligned} G(z) &= \frac{1 - \alpha z^{-1}}{KA(1-\alpha)}\left\{1 + \sum_{i=1}^{N-1} a_i z^{-i}\right\} \\ &= \frac{1}{KA(1-\alpha)}\{1 + (a_1 - \alpha)z^{-1} + (a_2 - \alpha a_1)z^{-2} + \ldots + \\ &\quad (a_{N-1} - \alpha a_{N-2})z^{-(N-1)} - \alpha a_{N-1} z^{-N}\} \end{aligned} \tag{1.3}$$

At this point, the following holds true.

$$\begin{aligned} B(z) = G(z)HP(z) &= \frac{1 - \alpha z^{-1}}{KA(1-\alpha)}\left\{1 + \sum_{i=1}^{N-1} a_i z^{-i}\right\} * \frac{K(1-\alpha)z^{-(m+1)}}{1 - \alpha z^{-1}} \\ &= \frac{1}{A} z^{-(m+1)}\left\{1 + \sum_{i=1}^{N-1} a_i z^{-i}\right\} = \frac{1}{A}\left\{\sum_{i=0}^{N-1} a_i z^{-(m+1+i)}\right\} \end{aligned} \tag{1.4}$$

where $a_0 = 1$.

Assuming $a_1=\ldots=a_{N-1}=1$ in equation 1.3, we have $A=1+a_1+\ldots+a_{N-1}=N$. Consequently, $$\begin{aligned} G(z) &= \frac{1}{KA(1-\alpha)}\{1 + (1-\alpha)z^{-1} + (1-\alpha)z^{-2} + \ldots + (1-\alpha)z^{-(N-1)} - \alpha z^{-N}\} \\ &= \frac{1}{K*N}\left\{\frac{1}{1-\alpha} + z^{-1} + z^{-2} + \ldots + z^{-(N-1)} - \frac{\alpha}{1-\alpha} z^{-N}\right\} \end{aligned} \tag{1.5}$$

From the equation above, we obtain $$B(z) = \frac{1}{N}\left\{\sum_{i=0}^{N-1} z^{-(m+i+1)}\right\} \tag{1.6}$$

FIG. 3 illustrates the results of calculating equations 1.5 and 1.6 discussed above. The upper graph of FIG. 3 represents the transfer function G(z) of the controller CON, and the lower graph represents the moisture percentage change B(z). The horizontal axis indicates time. In the figure, the process gain K is defined as 1, and the values of N and m as 6 and 3, respectively. Thus, the method of steam pressure manipulation was prescribed according to equation 1.6, on the assumption that a change in the production amount during grade change was linear and such that the production amount change was cancelled by a change in the moisture percentage caused by steam pressure manipulation.

This means that according to FIG. 2, the actual moisture percentage C(s) is given by subtracting the manipulation-caused moisture percentage change B(s) from the disturbance D(s). Thus, control has been carried out on the assumption that the disturbance D(s) changes linearly and such that the B(s) is increased linearly from time $t_0$ so as to compensate the disturbance D(s).

SUMMARY OF THE INVENTION

The present invention provides a method of manipulating dryer steam pressure in a paper machine during grade change. In the method, a change in the moisture percentage is determined from a change in the production amount during grade change, dryer steam pressure is manipulated so as to cancel the change in the moisture percentage, and the production amount in the course of grade change is calculated from basis weight and machine speed before and after the grade change.

The apparatus of the present invention for manipulating the dryer steam pressure comprises a first calculation part for calculating a steam pressure manipulation change value from a steam pressure prediction target value after grade change, a second calculation part for calculating another steam pressure manipulation change value from the nonlinear part of a change in the production amount, a multiplication part to which the output of the second calculation part is input so that the input value is multiplied by a weighting factor, and an addition part for summing the outputs of the multiplication part and first calculation part.

By using the dryer steam pressure manipulation apparatus and a steam pressure manipulation method described above, moisture percentage is kept constant during grade change so that such problems as sheet break are avoided and thereby plant uptime until the type of product is changed completely after grade change is increased.

DETAILED DESCRIPTION OF THE PREFERRED EMBODIMENTS

Preferred embodiments of the present invention will now be described in detail with reference to the accompanying drawings.

Figure 4:
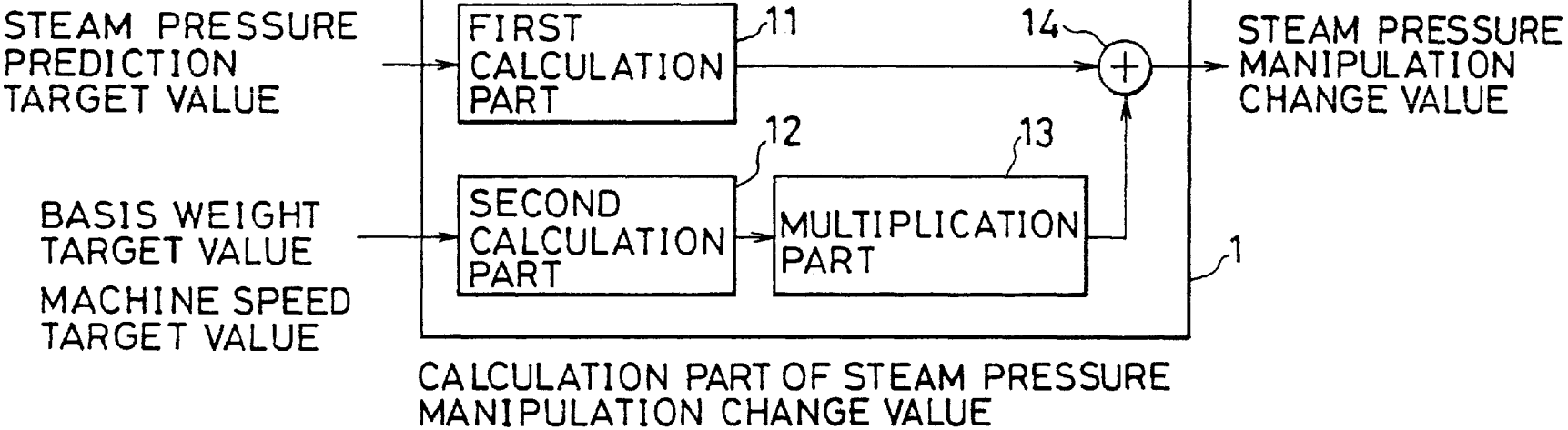
FIG. 4 is a block diagram showing one embodiment of the present invention.

FIG. 4 is a diagrammatic view showing a calculation part for calculating the amount of change in dryer steam pressure for a grade change according to the present invention. In the figure, a numeral 1 indicates the calculation part of steam pressure manipulation change value consisting of a first calculation part 11, a second calculation part 12, a multiplication part for multiplying the output of the second calculation part 12 by a weighting factor, and an addition part 14 for summing the outputs of the first calculation part 11 and multiplication part 13.

A steam pressure prediction target value and other values are input to the first calculation part 11, where a steam pressure manipulation change value determined from a predicted value of steam pressure after grade change is calculated and output. In some cases, another steam pressure manipulation change value for correcting disturbances other than a change in the production amount is calculated and added to the former steam pressure manipulation change value, and then the resulting value is output.

A basis weight target value, machine speed target value and other values are input to the second calculation part 12, where a steam pressure manipulation change value for correcting the nonlinear part of change in production amount during grade change is calculated and output. The multiplication part 13 multiplies the steam pressure manipulation change value by a weighting factor and outputs the resulting value. The outputs of the multiplication part 13 and first calculation part 11 are summed at the addition part 14 for output as another steam pressure manipulation change value. A value from 0 to 2.00 is used as the weighting factor.

As explained with reference to the prior art method, machine speed varies linearly during the control of grade change. The stock control valve is manipulated according to this linear change in machine speed, so that basis weight also varies linearly. In this case, a change in the production amount, i.e., the product of machine speed and basis weight, which is the main cause of a change in dryer load, is evaluated as described below.

Let us assume that basis weight before grade change is $B_1$, machine speed based on the production amount before grade change is $V_1$, basis weight after grade change is $B_2$, and machine speed based on the production amount after grade change is $V_2$. If we assume that basis weight and machine speed at the ith time of manipulation are B(i) and V(i), respectively, then B(i) and V(i) are expressed as $$B(i) = B_1 + \frac{i(B_2 - B_1)}{N}$$

$$V(i) = V_1 + \frac{i(V_2 - V_1)}{N}$$

where i=0, 1, 2, . . . , N (N is the frequency of manipulation). The production amount R(i) at this point is $$\begin{aligned} R(i) = B(i)V(i) &= \left\{B_1 + \frac{i(B_2 - B_1)}{N}\right\}\left\{V_1 + \frac{i(V_2 - V_1)}{N}\right\} \\ &= \frac{i^2}{N^2}(B_2 - B_1)(V_2 - V_1) + \frac{i}{N}\{(B_2 - B_1)V_1 + B_1(V_2 - V_1)\} + B_1V_1 \\ &\qquad (i = 0, 1, 2 \ldots N) \end{aligned} \tag{1}$$

Thus, R(i) is a quadratic equation of i.

In addition, the production amount $R^*(i)$ at the ith time of manipulation when the production amount is assumed to vary linearly before and after grade change is expressed as $$R^*(i) = \frac{i}{N}(B_2V_2 - B_1V_1) \tag{2}$$

The difference ΔR between equations 1 and 2 is calculated as $$\begin{aligned} \Delta R(i) &= R(i) - R^*(i) \\ &= \frac{i^2}{N^2}(B_2 - B_1)(V_2 - V_1) + \frac{i}{N}\{B_2V_1 - B_1V_1 + B_1V_2 - B_2V_2\} \\ &= \frac{i^2}{N^2}(B_2 - B_1)(V_2 - V_1) - \frac{i}{N}(B_2 - B_1)(V_2 - V_1) \\ &= -\frac{(N - i)i}{N^2}(B_2 - B_1)(V_2 - V_1) \\ &\qquad (i = 0, 1, 2, \ldots, N) \end{aligned} \tag{3}$$

Since $(B_2-B_1)(V_2-V_1)<0$ under normal conditions, equation 3 shown above is a parabola opening downwards and takes the maximum value of $-\frac{1}{4}(B_2-B_1)(V_2-V_1)$ when $i=\frac{N}{2}$.

From equation 1, a change in production amount as the result of subtracting the production amount before grade change from the production amount at the ith time of manipulation is given by $$R(i) - R(0) = \frac{i^2}{N^2}(B_2 - B_1)(V_2 - V_1) + \frac{i}{N}\{(B_2 - B_1)V_1 + B_1(V_2 - V_1)\} \tag{4}$$

where

R(i)=Production amount at the ith time of manipulation (i=0, 1, . . . ,

N (N is the frequency of output)

$B_1$=Basis weight before grade change (g/m$^2$)

$B_2$=Basis weight after grade change (g/m$^2$)

$V_1$=Machine speed before grade change (m/min)

$V_2$=Machine speed after grade change (m/min)

Changing equation 4 gives equation 5 below.

$$\frac{R(i) - R(0)}{R(0)} = \frac{i^2}{N^2}\left(\frac{B_2}{B_1} - 1\right)\left(\frac{V_2}{V_1} - 1\right) + \frac{i}{N}\left\{\left(\frac{B_2}{B_1} - 1\right) + \left(\frac{V_2}{V_1} - 1\right)\right\} \tag{5}$$

Now, we define two constants, one of which is a ratio of change $C_l$ in the moisture percentage due to a change in the production amount, and the other is a ratio of change $C_2$ in the moisture percentage due to a change in the steam pressure target value of a dryer. These constants are derived from the results of step-response testing of the stock control valve and steam pressure and given by $$C_1 = \frac{\Delta MP}{100 * \left(\frac{\Delta BD}{BD}\right)} \ (\%/\%) \tag{6}$$

where

ΔMP=Change in pre-dryer outlet moisture percentage

ΔBD=Change in basis weight before reeling (g/m$^2$)

BD=Target value of basis weight before reeling (g/m$^2$)

and $$C_2 = \frac{\Delta MP}{100 * \left(\frac{\Delta P}{Pf}\right)} \ (\%/\%) \tag{7}$$

ΔP=Change in dryer steam pressure (kPa)

Pf=Target value of absolute dryer steam pressure (kPa)

From equations 5 and 6 shown above, an increment $D_{i+1}$ in the moisture percentage due to a change in the production amount is given by $$Di = 100 * C_1 R(i) - \frac{R(0)}{R(0)}$$

where i=0, 1, . . . , N−1, N.

Figure 1:
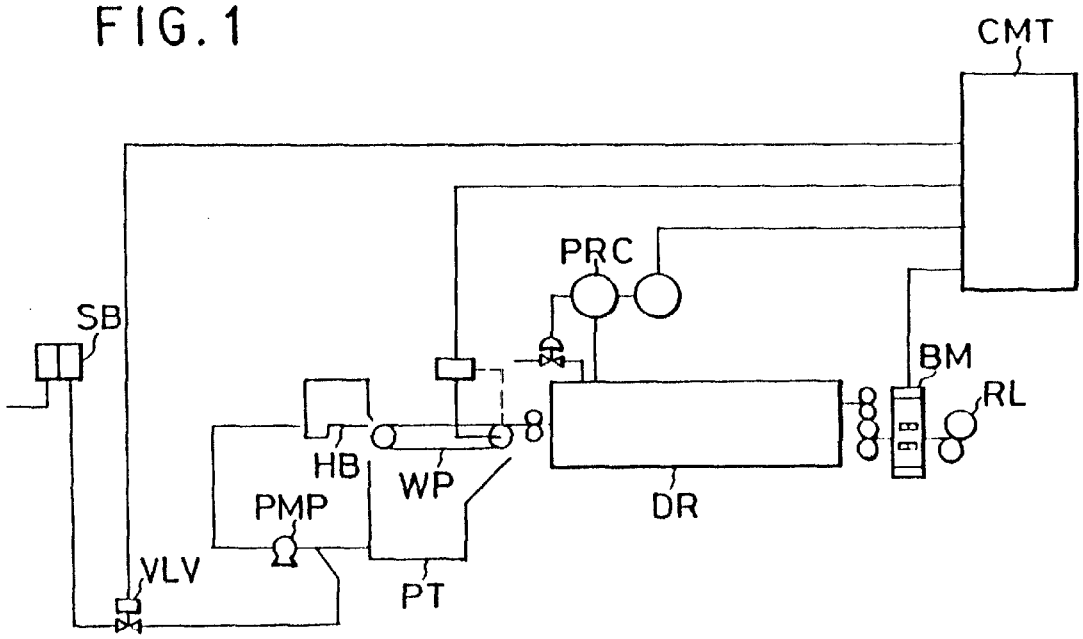
FIG. 1 is a diagrammatic view showing the configuration of a paper machine.
Figure 2:
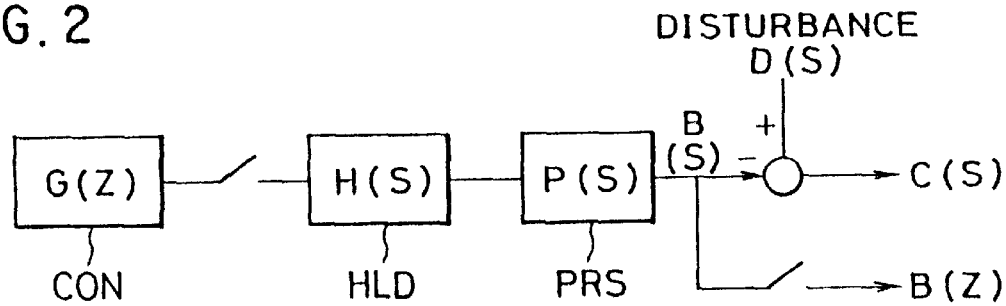
FIG. 2 is a diagrammatic view showing the configuration of a process model comprising a dead time element and a first-order delay system.
Figure 3:
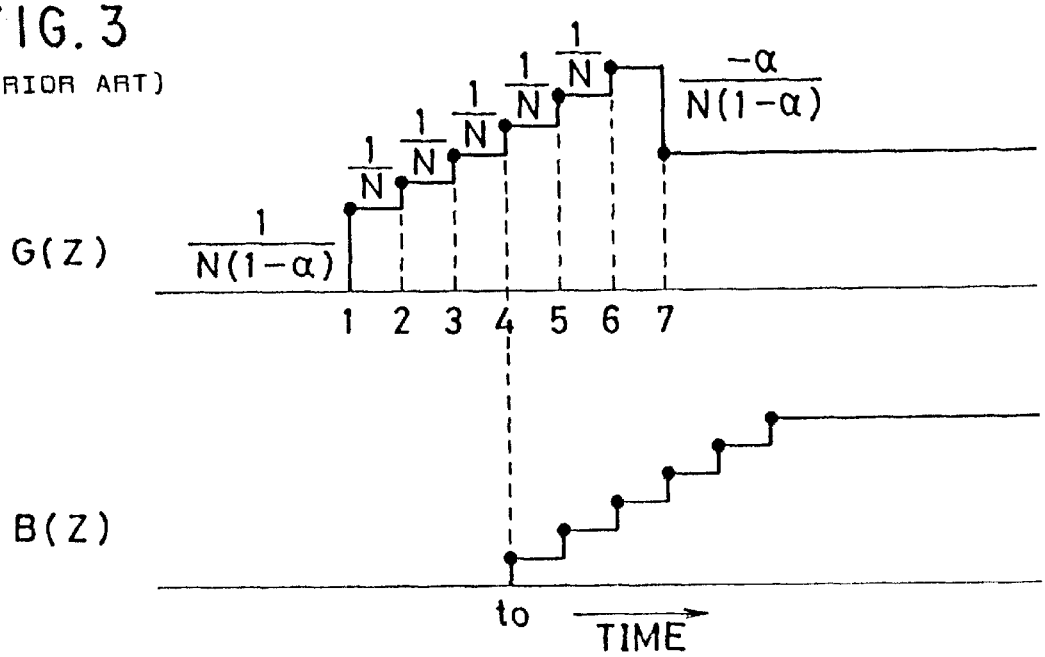
FIG. 3 (PRIOR ART)
FIG. 3 is a graphical view explaining the prior art method of steam pressure manipulation.

This increment in the moisture percentage due to a change in the production amount corresponds to the disturbance D(s) shown in FIG. 2. The moisture percentage change B(s) required for canceling the disturbance by steam pressure manipulation is calculated as described below.

Let us assume $$a_i = \frac{D_{i+1} - Di}{D_1} = \frac{R(i+1) - R(i)}{R(1) - R(0)} \quad (i = 0, 1 \ldots, N-1).$$

Then, we have $$A = \sum_{i=0}^{N-1} a_i = \frac{D_N}{D_1} = \frac{R(N) - R(0)}{R(1) - R(0)}$$

If we define the manipulated variable of steam pressure as equation 1.3 noted earlier, the change in MP due to steam pressure manipulation at each sampling time after the lapse of a dead time is derived from equation 1.4 as $$\text{Change in } MP = -\frac{a_i}{A} = -\frac{D_{i+1} - Di}{D_N}$$

Consequently, assuming the value of the manipulated variable of steam pressure is given by multiplying the value defined as equation 1.3 by $D_N$, namely $$G_{i+1} - G_i = \frac{D_N}{KA(1-\alpha)}(a_i - \alpha a_{i-1}) \tag{8}$$

where i=0, 1, . . . , N and $a_{-1}=0$, $a_0=1$, $a_N=0$, then a change in the moisture percentage due to steam pressure manipulation is $$-(B_{i+1} - B_i) = -\frac{a_i}{A} * D_N = -(D_{i+1} - D_i)$$

where i=0, 1, . . . , N−1. Thus, it is possible to cancel the increment in the moisture percentage due to the change in the production amount by means of steam pressure manipulation.

This means that equation 8 can be rewritten as shown below for more specific instances. Note here that coefficients C1 and C2 are given by equations 6 and 7 and the process gain K is given by K=100/Pf×C.

$$\begin{aligned}
\Delta G_1 &= G_1 - G_0 = \frac{D_N}{KA(1-\alpha)} = 100 * C_1 \frac{R(N) - R(0)}{R(0)} * \frac{Pf}{100} * \frac{1}{C_2 A(1-\alpha)} \\
&= \frac{C_1 * Pf}{C_2(1-\alpha)} * \frac{R(1) - R(0)}{R(0)} \\
\Delta G_{i+1} &= G_{i+1} - G_i = \frac{D_N}{KA(1-\alpha)} * (a_i - \alpha a_{i-1}) \\
&= 100 * C_1 \frac{R(N) - R(0)}{R(0)} * \frac{Pf}{100} * \frac{1}{C_2 A(1-\alpha)} * \frac{R(i+1) - (\alpha+1)R(i) + \alpha R(i-1)}{R(1) - R(0)} \\
&= \frac{C_1 * Pf}{C_2(1-\alpha)} * \frac{R(i+1) - (\alpha+1)R(i) + \alpha R(i-1)}{R(0)} \quad (i = 1, \ldots N-1) \\
\Delta G_{N+1} &= G_{N+1} - G_N = \frac{D_N}{KA(1-\alpha)} * (-\alpha a_{N-1}) \\
&= 100 * C_1 \frac{R(N) - R(0)}{R(0)} * \frac{Pf}{100} * \frac{1}{C_2 A(1-\alpha)} * \frac{-\alpha(R(N) - R(N-1))}{R(1) - R(0)} \\
&= \frac{C_1 * Pf}{C_2(1-\alpha)} * \frac{-\alpha(R(N) - R(N-1))}{R(0)}
\end{aligned}$$

where $\Delta G_{i-1}$=Change in pre-dryer steam pressure target value (kPa); i=0, 1, . . . , N $\alpha=\exp(-T/T_0)$ T=Manipulation period (=10 sec)

$T_0$=Process time constant (sec)

In addition to the above-discussed change in the production amount, the causes of disturbance responsible for a change in the dryer load during actual grade change include:

- a change in the moisture percentage at a pre-dryer inlet due to a change in the machine speed or basis weight, or due to a change in the wire retention resulting from a change in the blending of raw material or from a change in the capability of water drainage in a press process;
- a change in the efficiency of drying due to a change in the blending of raw material; and
- a change in the drying ability due to a change in the steam shutdown state of a dryer cylinder.

A steam pressure target value after grade change must be determined according not only to a change in the production amount but to the above-mentioned causes and other hard-to-analyze process conditions. There are some algorithms that have been devised in consideration of these factors. In the embodiment discussed here, we will use values determined by using these known algorithms as steam pressure target values after grade change. The actual manipulated variable of steam pressure is determined by summing the manipulated variable for compensating nonlinear changes in the production amount in the course of grade change and the manipulated variable determined from the steam pressure target value after grade change.

The amount of change in steam pressure for compensating for errors due to the nonlinearity of the production amount during grade change is given by $$\Delta G_1^1 = \frac{C_1 * Pf}{C_2(1-\alpha)} * \frac{(R(1)-R^*(1))-(R(0)-R^*(0))}{R(0)} \quad (9)$$

$$\Delta G_{i+1}^1 = \frac{C_1 * Pf}{C_2(1-\alpha)} * \frac{(R(i+1)-R^*(i+1)) - (\alpha+1)(R(i)-R^*(i)) + \alpha(R(i-1)-R^*(i-1))}{R(0)}$$

$$i = 1, \ldots, N-1$$

$$\Delta G_{N+1}^1 = \frac{C_1 * Pf}{C_2(1-\alpha)} * \frac{-\alpha\{(R(N)-R^*(N))-(R(N-1)-R^*(N-1))\}}{R(0)}$$

Note that $R(i)-R^*(i)$ is given by equation 3 discussed earlier, and $\alpha=\exp(-T/T_0)$. T denotes the period of manipulation and a value of, for example, 10 sec is used for the period.

Equation 9 is changed by using equation 3 into the following.

$$\Delta G_1' = \frac{C_1 * Pf}{C_2(1-\alpha)N^2} = \left(\frac{B_2}{B_1}-1\right) * \left(\frac{V_2}{V_1}-1\right)\{-(N-1)\} \quad (10)$$

$$\Delta G_{i+1}' = \frac{C_1 * Pf}{C_2(1-\alpha)N^2} = \left(\frac{B_2}{B_1}-1\right) * \left(\frac{V_2}{V_1}-1\right)\{(1-\alpha)(2i-N)+(1+\alpha)\}$$

$$(i = 1, 2 \ldots, N-1)$$

$$\Delta G_{N+1}' = \frac{C_1 * Pf}{C_2(1-\alpha)N^2} = \left(\frac{B_2}{B_1}-1\right) * \left(\frac{V_2}{V_1}-1\right)\{-\alpha(N-1)\}$$

Furthermore, from the steam pressure prediction target value $P_2$ after grade change, a steam pressure manipulation change value is determined as shown below, by using such a prior art method as the one described in the specification of Japanese Patent Publication No. 117818 of 1984.

$$\Delta G_1^2 = \frac{P_2-P_1}{A(1-\alpha)} = \frac{P_2-P_1}{1-\alpha} * \frac{1}{N} \quad (11)$$

$$\Delta G_{i+1}^2 = \frac{P_2-P_1}{1-\alpha} * \frac{(i+1)-(\alpha+1)*i+\alpha(i-1)}{N} = \frac{P_2-P_1}{N} \quad (i = 1, 2 \ldots, N-1)$$

$$\Delta G_{N+1}^2 = \frac{P_2-P_1}{1-\alpha} * \frac{-\alpha}{N}$$

where $P_1$ is a pre-dryer steam pressure target value (kPa) before grade change, and $P_2$ is a pre-dryer steam pressure target value (kPa) after grade change.

An actual steam pressure manipulation change value AGi is given by equation 12 below, where a weighting factor $C_0$ is introduced to the manipulated variable determined by equations 10 and 11 noted above.

$$\Delta G_i = C_0 * \Delta G^1_i + \Delta G^2_i \ (i=1, \cdots N, N+1) \quad (12)$$

For the weighting factor $C_0$, a value from 0.0 to 2.00 is used.

As explained with reference to the prior art method, a long dead time and a large delay time constant are inherent with the manipulation of a dryer and a stock control valve. For this reason, in actual applications, steam pressure manipulation corresponding to the value given by equation 12 is carried out earlier than the starting time of grade change, by as much as the dead time involved during change in the moisture percentage caused by the usual manipulation of steam pressure.

Figure 5:
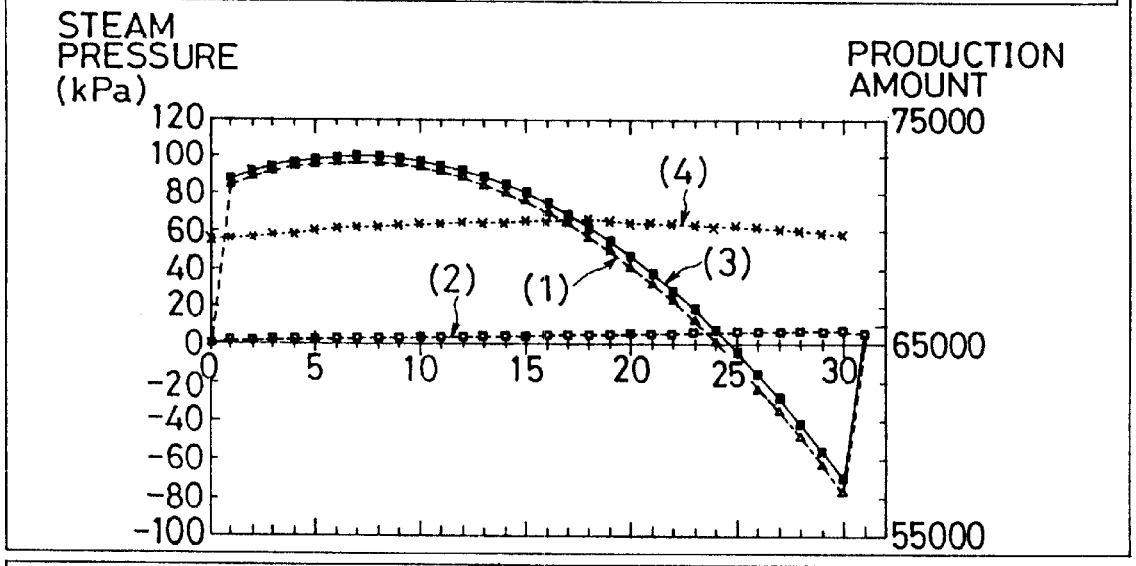
FIG. 5 is a graphical view explaining the advantageous effects of the present invention.
Figure 5:
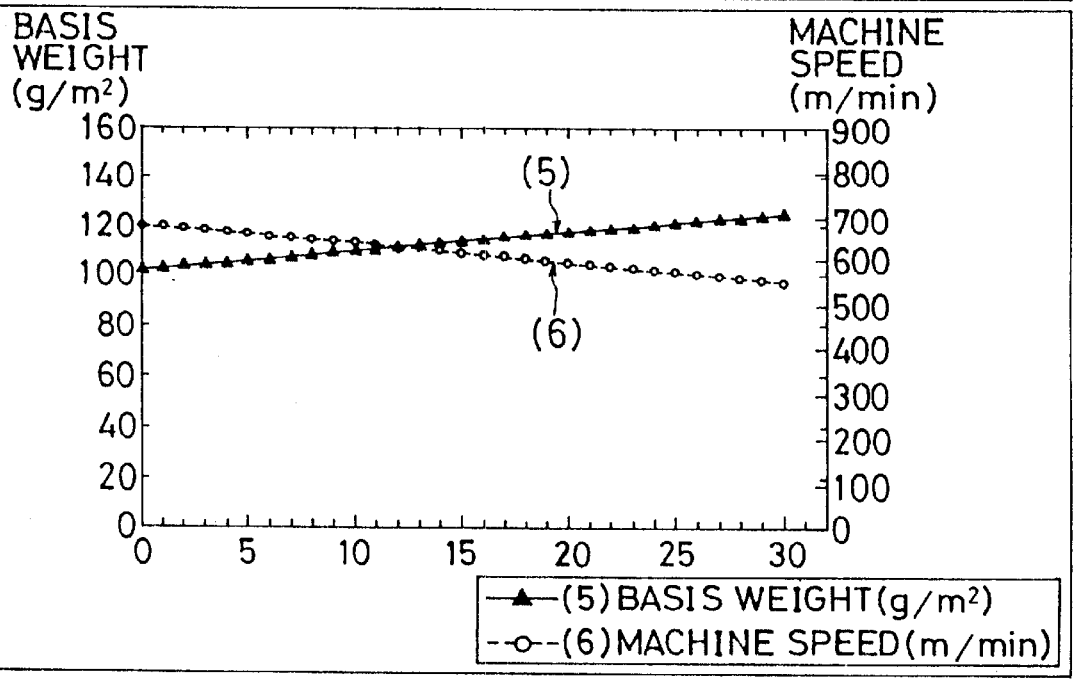

FIG. 5 is a graphical view showing one example of control performance during grade change provided by the embodiment described here. In this example, the control performance is plotted by substituting 0.549 for $C_1$ in equation 6, and 0.026 for $C_2$ and 300 for the dryer pressure target value Pf in equation 7, and by defining the time constant $T_0$ as $T_0$=86 sec and the variable $\alpha$ as $\alpha=\exp(-10/86)=0.890227$. In addition, the basis weight, machine speed and steam pressure before grade change are defined as 101.6 g/m$^2$, 680 m/min and 211 kPa, respectively. Likewise, the basis weight, machine speed and steam pressure after grade change are defined as 127.1 g/m$^2$, 550 m/min and 217 kPa, respectively.

The upper graph of FIG. 5 shows a change in the manipulated variable of steam pressure during grade change. Curve 1 represents the manipulated variable ($\Delta G^1_i$ in equation 10) for compensating errors due to the nonlinearity of the production amount discussed in this embodiment; curve 2 represents the manipulated variable of steam pressure in the prior art control method; curve 3 represents the total manipulated variable ($\Delta G^i$ in equation 12) in this embodiment; and curve 4 represents the production amount. Note that hereinafter, the weighting factor is defined as $C_0$=1.0 in every example of control performance.

It is evident from the graph that the manipulated variable of steam pressure applied in this embodiment greatly differs from that in the prior art and that the production amount is represented as a convex curve. The lower graph of FIG. 5 illustrates changes in the basis weight and machine speed. From the graph, it is understood that both the basis weight and machine speed change linearly.

Figure 6:
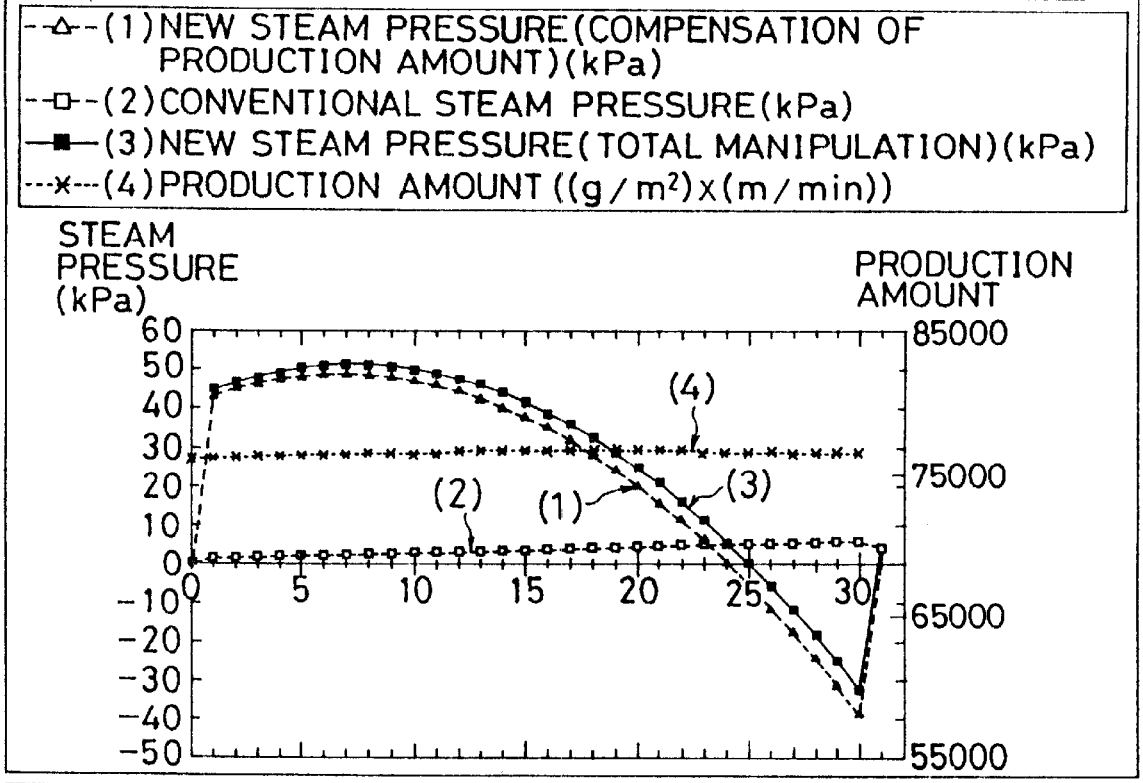
FIG. 6 is another graphical view explaining the advantageous effects of the present invention.
Figure 6:
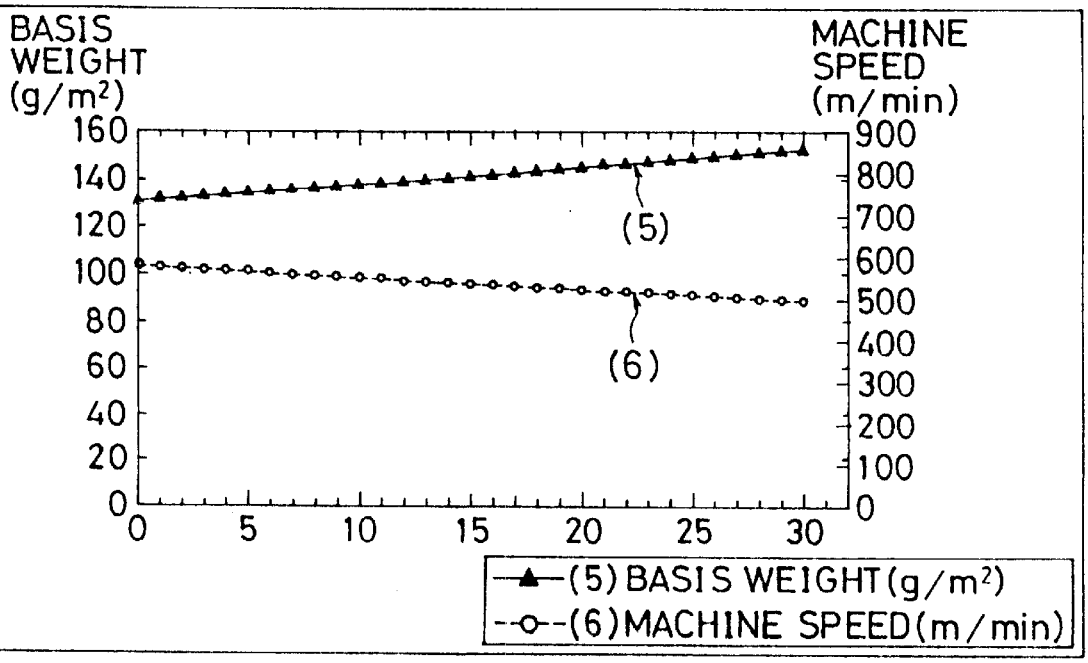

FIG. 6 is another example of control performance where a minor change is made to the conditions noted above. Note that elements identical to those of FIG. 5 are referenced alike and excluded from the explanation. In this embodiment, the basis weight, machine speed and pre-dryer steam pressure before grade change are defined as 131.05 g/m$^2$, 580 m/min and 212 kPa, respectively. Likewise, the basis weight, machine speed and pre-dryer steam pressure after grade change are defined as 153.05 g/m$^2$, 500 m/min and 217 kPa, respectively. From the figure, it is understood that the embodiment of FIG. 6 is similar in tendency to that of FIG. 5.

Figure 7:
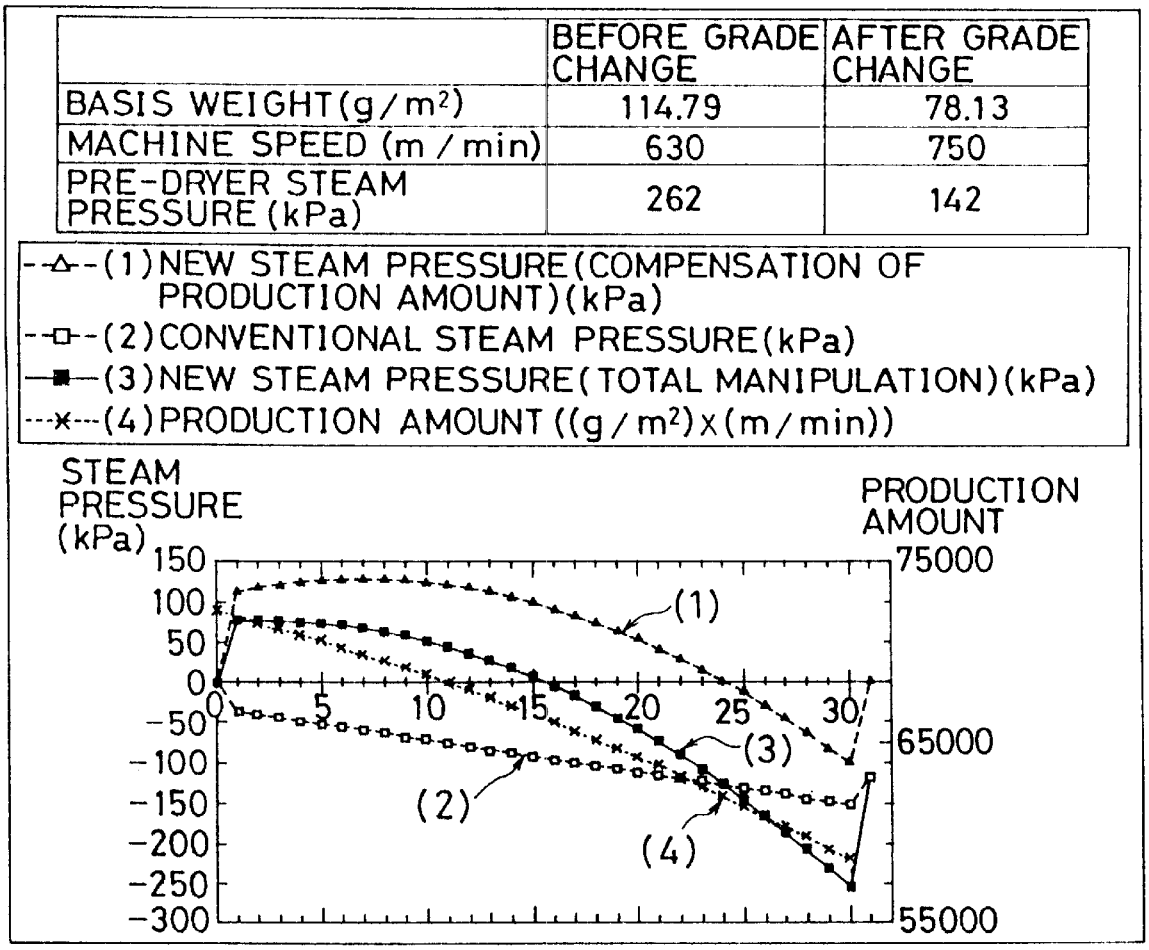
FIG. 7 is yet another graphical view explaining the advantageous effects of the present invention.
Figure 7:
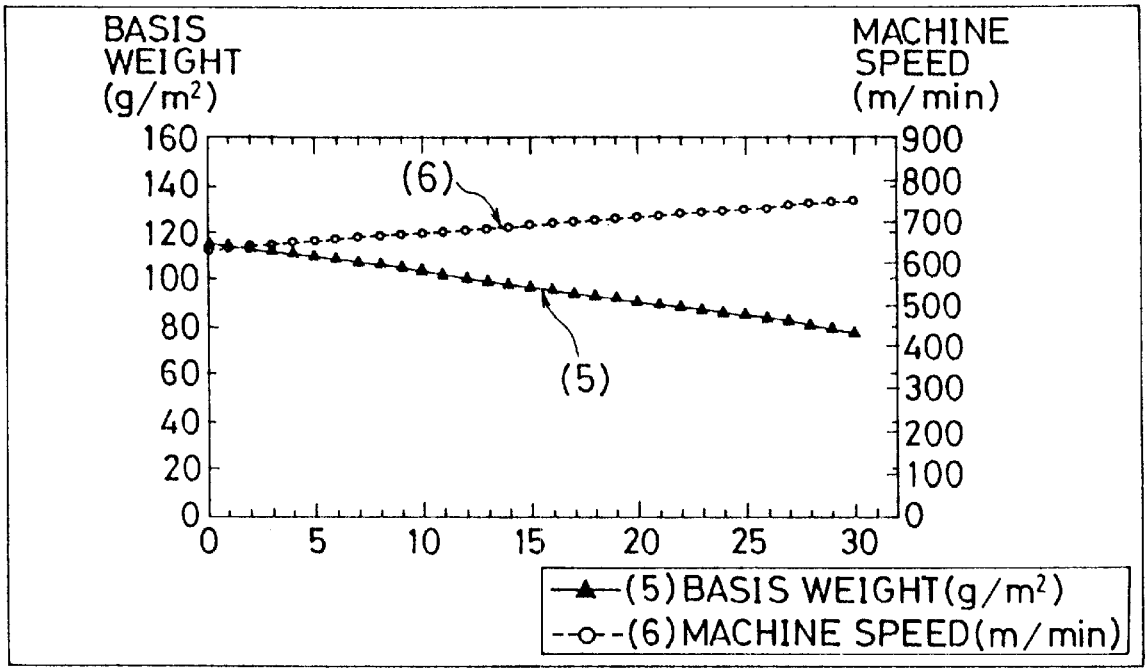
Figure 8:
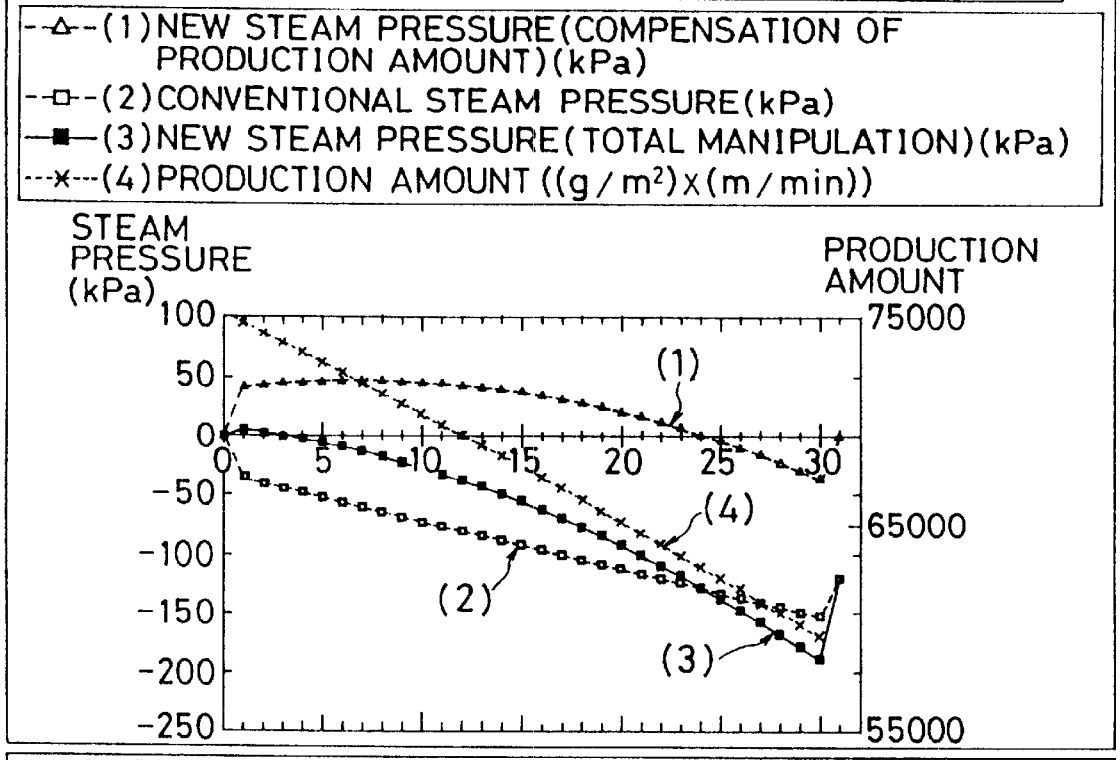
FIG. 8 is still another graphical view explaining the advantageous effects of the present invention.
Figure 8:
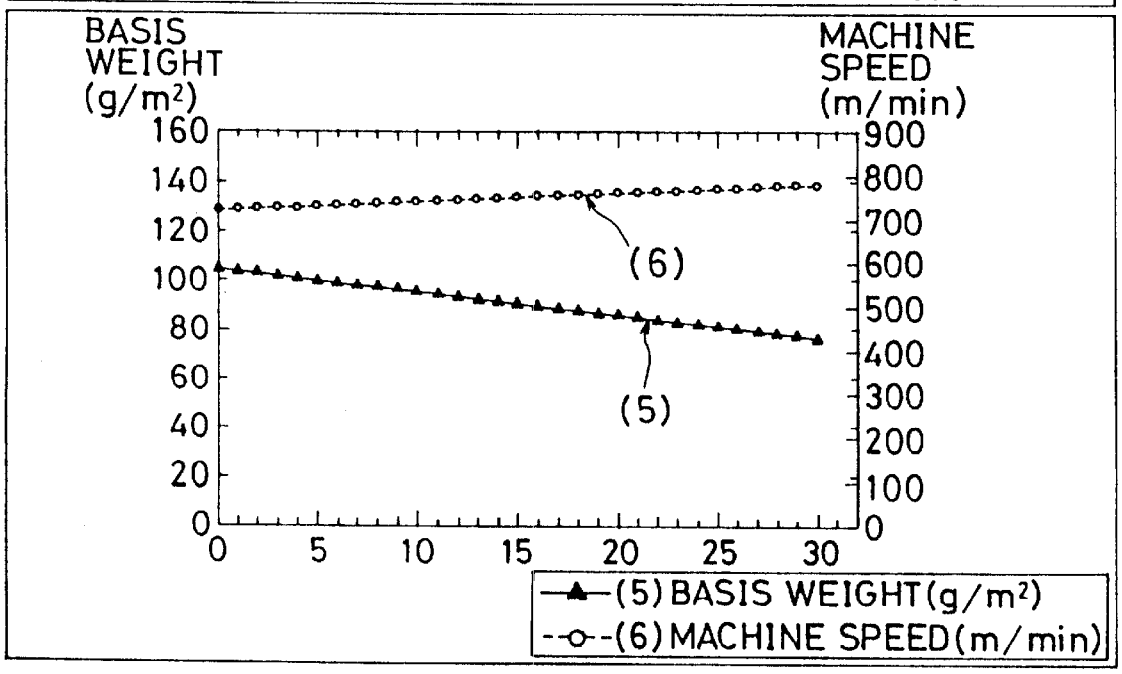

Unlike the embodiments of FIGS. 5 and 6, the embodiments of FIGS. 7 and 8 are characterized by decreases in the production amount before and after grade change. This means that the pre-dryer steam pressure target value $P_2$ after grade change based on the conventional algorithm is greater than the steam pressure target value $P_1$ before grade change in these instances of control performance. In FIG. 7, the basis weight, machine speed and pre-dryer steam pressure before grade change are defined as 114.79 g/m$^2$, 630 m/min and 262 kPa, respectively. Likewise, the basis weight, machine speed and pre-dryer steam pressure after grade change are defined as 78.13 g/m$^2$, 750 m/min and 142 kPa, respectively. In FIG. 8, the basis weight, machine speed and pre-dryer steam pressure before grade change are defined as 104.4 g/m$^2$, 720 m/min and 254 kPa, respectively. Likewise, the basis weight, machine speed and pre-dryer steam pressure after grade change are defined as 76.38 g/m$^2$, 780 m/min and 135 kPa, respectively.

As is evident from the explanation heretofore given, the following advantageous effects are offered by the present invention.

1) A change in the moisture percentage is determined from a change in the production amount during grade change. Then, dryer steam pressure is manipulated so as to cancel this moisture percentage change. Consequently, it is possible to make the steam pressure agree with a target value by suppressing variations in the moisture percentage due to a change, in particular a nonlinear change, in the production amount. This means that it is possible to avoid such problems as sheet break, reduce the time required to completely change to another type of product after grade change, and thereby increase the efficiency of plant operation.

2) The production amount at any moment during grade change is calculated from the basis weight and machine speed measured at the moment. Consequently, it is possible to precisely determine a change in the production amount, and make the steam pressure agree with a target value by preventing variances in the moisture percentage due to a nonlinear change in the production amount.

3) A value obtained by adding a steam pressure manipulation change value calculated according to a steam pressure prediction target value after grade change to a value determined by multiplying a steam pressure manipulation change value, which is derived from the nonlinearity of change in the production amount during grade change, by a weighting factor, is used as the actual steam pressure manipulation change value.

With this strategy, it is possible to combine the manipulation method of the present invention wherein the moisture percentage is made to agree with a target value by preventing a change in the moisture percentage due to the nonlinearity of change in the production amount, with the conventional manipulation method based on a steam pressure prediction target value after grade change.

4) As the actual steam pressure manipulation change value, the method of the present invention uses a value obtained by adding a steam pressure manipulation change value, which includes another steam pressure manipulation change value determined on the assumption that the production amount in the course of grade change varies linearly, to a value determined by multiplying a second steam pressure manipulation change value, which is derived from the nonlinear part of change in the production amount during grade change, by a weighting factor.

With this strategy, it is possible to combine the manipulation method of the present invention wherein the moisture percentage is made to agree with a target value by preventing a change in the moisture percentage due to the nonlinearity of change in the production amount, with the conventional manipulation method based on the assumption that the production amount changes linearly.

5) As the weighting factor, a value no smaller than 0 but no greater than 2.0 is used.

With this strategy, it is possible to adjust the degree of contribution of a manipulation change value resulting from the nonlinearity of the production amount. In addition, setting the weighting factor to 0 provides the same manipulation change value as that of the conventional manipulation method, making it possible to prevent any sudden change in plant operation due to a change in the software used.

6) A dryer steam pressure manipulation unit used during grade change in a paper machine is composed of a first calculation part for calculating a steam pressure manipulation change value from a steam pressure prediction target value after grade change, a second calculation part for calculating another steam pressure manipulation change value from the nonlinear part of change in the production amount, a multiplication part for multiplying the output of the second calculation part by a weighting factor, and an addition part for summing the outputs of the multiplication part and first calculation part.

With this strategy, it is possible to combine the manipulation method of the present invention wherein the moisture percentage is made to agree with a target value by preventing a change in the moisture percentage due to the nonlinearity of change in the production amount, with the conventional manipulation method based on a steam pressure prediction target value after grade change.

7) A dryer steam pressure manipulation unit used during grade change in a paper machine is composed of a first calculation part for calculating a steam pressure manipulation change value including another steam pressure manipulation change value determined on the assumption that the production amount in the course of grade change varies linearly, a second calculation part for calculating yet another steam pressure manipulation change value from the nonlinear part of change in the production amount, a multiplication part for multiplying the output of the second calculation part by a weighting factor, and an addition part for summing the outputs of the multiplication part and first calculation part.

With this strategy, it is possible to combine the manipulation method of the present invention wherein the moisture percentage is made to agree with a target value by preventing a change in the moisture percentage due to the nonlinearity of change in the production amount, with the conventional manipulation method based on the assumption that the production amount changes linearly.

What is claimed is:

1. A method of manipulating dryer steam pressure in a paper making machine during grade change when production amount changes, comprising the steps of:

obtaining a first steam pressure manipulating change value from a value determined on assumption that production amount during course of grade change varies linearly;

obtaining a second steam pressure manipulating change value from a value determined by non-linear change in production amount during course of grade change;

obtaining a first value by adding said first steam pressure manipulating change value to a second value obtained by multiplying said second steam pressure manipulating change value by a weighting factor between 0 and 2.0; and using said first value as an actual steam pressure manipulating value.

2. The method of claim 1, wherein said first steam pressure manipulating change value is calculated according to a steam pressure target value after grade change.

3. An apparatus for manipulating dryer steam pressure in a paper making machine, said apparatus comprising:

means for obtaining a first steam pressure manipulating change value from a value determined on assumption that production amount during course of grade change varies linearly;

means for obtaining a second steam pressure manipulating change value from a value determined by non-linear change in production amount during course of grade change;

means for obtaining a first value by adding said first steam pressure manipulating change value to a second value obtained by multiplying said second steam pressure manipulating change value by a weighting factor between 0 and 2.0; and means for using said first value as an actual steam pressure manipulating value.

4. The apparatus of claim 3, wherein said means for obtaining a first steam pressure manipulating change value comprises means for calculating said first steam pressure manipulating change value according to a steam pressure target value after grade change.

* * * * *